US009174257B2

(12) United States Patent
Noe

(10) Patent No.: US 9,174,257 B2
(45) Date of Patent: Nov. 3, 2015

(54) STRETCH-BENDING STRAIGHTENER

(75) Inventor: Andreas Noe, Kerken (DE)

(73) Assignee: BWG Bergwerk—und Walzwerk—Maschinenbau GmbH, Duisburg (DE)

( * ) Notice: Subject to any disclaimer, the term of this patent is extended or adjusted under 35 U.S.C. 154(b) by 314 days.

(21) Appl. No.: 13/697,508

(22) PCT Filed: Jun. 22, 2011

(86) PCT No.: PCT/EP2011/060394

§ 371 (c)(1),
(2), (4) Date: Dec. 17, 2012

(87) PCT Pub. No.: WO2011/161134

PCT Pub. Date: Dec. 29, 2011

(65) Prior Publication Data

US 2013/0111962 A1 May 9, 2013

(30) Foreign Application Priority Data

Jun. 23, 2010 (DE) ..... 10 2010 024 714

(51) Int. Cl.
*B21D 1/05* (2006.01)
*B21D 1/02* (2006.01)
*B21D 41/02* (2006.01)

(52) U.S. Cl.
CPC .. *B21D 1/05* (2013.01); *B21D 1/02* (2013.01); *B21D 41/026* (2013.01); *B21D 41/028* (2013.01)

(58) Field of Classification Search
CPC ..... B21D 1/06; B21D 1/02; B21D 1/05
USPC ..... 72/127, 160–165, 183, 199, 205, 247
See application file for complete search history.

(56) References Cited

U.S. PATENT DOCUMENTS 4,057,989 A * 11/1977 Takechi et al. ..... 72/128
4,898,013 A * 2/1990 Mazodier et al. ..... 72/165

(Continued)

FOREIGN PATENT DOCUMENTS

DE 3885019 B 5/1994
JP 59137121 B 8/1984

(Continued)

*Primary Examiner* — Debra Sullivan
(74) *Attorney, Agent, or Firm* — Andrew Wilford

(57) ABSTRACT

The invention relates to a method and stretch-bending straightener for straightening metal strips (1) by stretch-bending, comprising a plurality of straightening rolls (5*a*, 6*a*, 7*a*, 8*a*) which are arranged behind one another in the strip flow direction (D) and spaced from one another in the strip flow direction (D), wherein the strip (1) subject to tensile stress below the limit of elasticity is alternately bent around the straightening rolls (5*a*, 6*a*, 7*a*, 8*a*), undergoing plastic elongation, wherein a deflecting roll (5*b*, 6*b*, 7*b*) is arranged upstream of one or more straightening rolls (5*a*, 6*a*, 7*a*), respectively, wherein said straightening rolls can be adjusted relative to the strip (1) and wherein said deflecting roll has a larger diameter than the respective downstream straightening roll. Said method and said system are characterized in that, in order to vary the immersion depth, the straightening rolls (5*a*, 6*a*, 7*a*) can be adjusted relative to the associated deflecting roll (5*b*, 6*b*, 7*a*) such that the free strip length (F) between the nm-off point (9) of the strip (1) from the deflecting roll to the run-on point (10) of the strip (1) onto the associated straightening roll does not exceed a predefined maximum value, above which longitudinal undulations of the strip form. The system is preferably designed such that, as the immersion depth and/or the angle of contact are varied, the free strip length never exceeds the maximum value over the entire adjusting range.

22 Claims, 4 Drawing Sheets

(56) References Cited

U.S. PATENT DOCUMENTS

| | | | | |
|---|---|---|---|---|
| 5,953,946 | A | 9/1999 | Muecke | |
| 6,253,587 | B1 * | 7/2001 | Nolden et al. | 72/7.4 |
| 6,318,141 | B1 * | 11/2001 | Tokunaga | 72/164 |

FOREIGN PATENT DOCUMENTS

| | | | |
|---|---|---|---|
| JP | 2001009523 | B | 1/2001 |
| JP | 2008080372 | B | 4/2008 |

* cited by examiner

STRETCH-BENDING STRAIGHTENER

CROSS REFERENCE TO RELATED APPLICATIONS

This application is the US-national stage of PCT application PCT/EP2011/060394 filed 22 Jun. 2011 and claiming the priority of German patent application 102010024714.6 itself filed 23 Jun. 2010.

FIELD OF THE INVENTION

The invention relates to a method and apparatus for stretch-bend leveling metal strip, with several straightening rollers in a row one after the other in the (horizontal or essentially horizontal) strip-travel direction and spaced apart in the strip-travel direction, the strip tensioned below the elastic limit being bent bidirectionally around the straightening rollers and thereby undergoing plastic stretching, one deflection roller upstream of one or more straightening rollers being movable relative to the strip and having a larger diameter than the straightening roller downstream.

BACKGROUND OF THE INVENTION

With stretch-bend leveling in a stretch-bend leveler of this type or a stretch-bend leveling stand of this type, the strip as a rule is under tension below the elastic limit or yield point and the strip is bent around the straightening rollers in the plastic or elastic-plastic range bidirectionally. The straightening rollers acting in a plastic or elastic-plastic manner are also referred to as stretch rollers. The amount by which the strip (overall) is plastically stretched and is consequently elongated is referred to as the stretch ratio.

With a stretch-bend leveler of this type nonplanar metal strips can be straightened and consequently nonplanarity can be eliminated. Nonplanarity means, for example, strip waviness and/or strip camber resulting from length differences of the strip fibers in the strip plane. However, nonplanarity also means strip curvature in the longitudinal and/or transverse direction resulting from bending moments in the strip, for example, if the strip was elastically/plastically bent around deflection rolls, or is caused by elastic-plastic deformations when winding up the strip. Longitudinal curvatures are also referred to as coil set, transverse curvatures as cross bow. In the course of stretch-bend leveling, the nonplanar strip is bent (bidirectionally) around rollers with a sufficiently small diameter under a tension that is below the elastic limit $R_E$ or the technical elastic limit $R_{p0.01}$ of the strip material, so that with the superimposition of the tensile stress with the bending, an elastic/plastic deformation of the strip is generated. The strip is plastically elongated, the amount of the plastic elongation being referred to as the stretch ratio. In the case of the plastic elongation, the originally short strip fibers are elongated to a relatively greater extent. In the ideal case after straightening all of the strip fibers have the same length so that in principle an ideally straightened strip free from waviness or strip cambers should be produced. This is not always achieved fully in practice, so that slight residual nonplanarity (for example, center waves or edge waves) can remain in the strip. Moreover, due to the bidirectional bending, residual bending moments are induced in the strip that can lead to undesirable plastic residual curvatures after straightening in the longitudinal direction (coil set) or transverse direction (cross bow). Through suitable coordination of the bending intensities on the individual rolls, the residual bending moments can be basically minimized. To this end it has already been proposed in different ways to adjust the geometry of the stretch-bend leveling stand to achieve the best possible straightening results.

Moreover, it is basically known from practice to provide deflection rolls upstream, between and/or downstream of the straightening rollers, which deflection rolls have a much larger diameter than the straightening rollers and generally have only an elastic effect.

Thus a device for leveling a metal strip is known, for example, from EP 0 298 852 (or DE 38 85 019) [U.S. Pat. No. 4,898,013], in which several stretch-bend leveling rollers are provided between a set of input tension rollers and a set of output tension rollers. Deflection rollers can be provided at different locations of the apparatus, which deflection rollers are primarily used to guide the strip during its travel through the apparatus along a certain path.

In a similar manner the professional article "Benefits of a new leveler technology for packaging steels: Multi-roller tension leveler" (Emmanuel Dechassey, Irsid, Arcelor Group, METEC Congress June 2003) describes a stretch-bending-leveler with four straightening rollers. There the overlap of the first straightening unit (first and second straightening roller) and the overlap of the second straightening unit (third and fourth roller) are movable. In turn several deflection rollers with larger diameter are integrated into the apparatus.

The stretch-bend levelers known from practice, in which deflection rollers with elastic action are also provided optionally, have proven to be basically useful, but can be developed further.

OBJECT OF THE INVENTION

The object of the invention is therefore to create a stretch-bend leveling method and a stretch-bend leveler of the type described above with which nonplanarities can be eliminated particularly reliably and efficiently.

SUMMARY OF THE INVENTION

To solve this problem, the invention teaches for a generic method for stretch-bend leveling metal strip of the type described at the outset, that the straightening roller for the variation of the immersion depth is moved relative to the respective deflection roller such that the free strip length between the run-off point of the strip from the deflection roller up to the take-up point of the strip on the straightening roller does not exceed a predetermined maximum value above which longitudinal waviness of the strip forms.

Particularly preferably, the straightening roller to vary the immersion depth is moved relative to the deflection roller such that the free strip length has a maximum value of 8% of the (maximum) strip width, preferably does not exceed 4% of the (maximum) strip width. Thus taking into consideration usual strip widths, it can be expedient that the free strip length does not exceed a maximum value of 150 mm, preferably 100 mm, particularly preferably 70 mm.

The invention is thereby first based on the realization that in a conventional stretch-bend leveling stand in a first apparatus section with several straightening rollers primarily the stretch ratio is produced, and that in a second apparatus section with further straightening rollers the residual bending moments are essentially eliminated. Furthermore, the invention is based on the realization that it is expedient at least in the first apparatus section with the straightening rollers, with which primarily the stretch ratio is produced, to provide each straightening roller with a respective deflection roller. Practical tests as well as theoretical calculations according to the Finite Element Method (FEM) have shown that the straightening result for a given strip depends on the number and geometric arrangement of straightening rollers among one another and between straightening rollers and deflection rollers. Larger spacings between the straightening rollers seen in the strip travel direction lead to smaller or completely eliminated residual waviness. This means that in practice the aim is to provide the largest possible spacings between the individual straightening rollers. However, in practice these large spacings between the individual straightening rollers can mean that the strips running through have a tendency to (elastic) longitudinal waviness. This longitudinal waviness is also referred to as "handkerchief effect." This effect occurs in particular with thin strips that are under high tensile stress over a larger distance. If a longitudinally wavy strip of this type now runs over a straightening roller, this longitudinal waviness is plastically embossed in the strip, so that the straightening result is influenced negatively. An effect of this type occurs mainly on straightening rollers on which the strip is still perceptibly plastically elongated. For the last straightening rollers, with which essentially only a partially plastic residual curvature correction is carried out, this elastic longitudinal waviness is unimportant or only of secondary importance.

Through the measures according to the invention it is now possible to work with relatively large spacings between the straightening rollers without the described problems occurring. According to the invention, the elastic longitudinal waviness is first eliminated in that the strip upstream of the straightening roller is first guided over a deflection roller. After the take-up point of the strip from the deflection roller, the strip runs after a certain free strip length onto the straightening roller provided downstream of the deflection roller. Tests have now led to the surprising result that longitudinal waviness upstream of the straightening roller can be avoided particularly reliably if the free strip length between the run-off point of the strip from the deflection roller to the take-up point of the strip onto the following straightening roller is minimized. Within the scope of the invention, consequently the advantageous larger spacings between the straightening rollers can be set which lead to slight or completely eliminated residual waviness without the expected problems with elastic residual waviness then occurring.

In general it is necessary in a stretch-bend leveler to process strips of different thickness, width and yield point. To this end it is necessary, to be able to vary the bending intensity of the individual straightening rollers. To this end the immersion depth or the wrap angle of the strip around the straightening roller is varied. Preferably, in the course of this variation with different immersion depths or wrap angles the straightening roller is positioned such that the free strip length does not exceed the maximum value over the entire adjustment region. The stretch-bend leveler is consequently designed such that the creation of longitudinal waviness is avoided over the entire adjustment range. This is achieved with conventional adjustment of the straightening roller perpendicular or approximately perpendicular to the strip-travel direction when the spacing of the straightening roller to the deflection roller is small, namely so small that the free strip length over the entire adjustment region always remains below the maximum value or does not exceed the maximum value. Consequently, it can be expedient to position the straightening roller comparatively closely downstream of the deflection roller or to position the deflection roller comparable closely upstream of the straightening roller, so that the free strip lengths are minimized even with conventional adjustment. The available adjustment range for the wrap angle or the immersion depth is comparatively small with this approach.

In a preferred further development, the invention therefore proposes that the straightening roller on varying the immersion depth can be moved essentially angularly of the deflection rollers or tangentially to the deflection roller. In this manner it is ensured that when varying the immersion depth the free strip length is kept minimal, namely even when a relatively large spacing is set between the deflection roller and the straightening roller. Such a large spacing ensures that the immersion depth or the wrap angle can be varied over a large range. Nevertheless, the free strip length is always minimized due to the particularly preferred adjustment manner so that longitudinal waviness can be avoided.

This can be realized, for example, in that the straightening roller for the purpose of a linear adjustment is moved in a straight line on an adjustment track extending obliquely to the strip-travel direction, namely preferably relative to a deflection roller mounted stationary. The adjustment on an oblique adjustment track has the advantage over the conventional "perpendicular" adjustment that the straightening roller in the course of the adjustment moves tangentially, as it were, along the surface of the deflection roller so that the free strip length remains comparatively small, namely even with relatively large variations of the immersion depth.

Alternatively, it is possible to move the straightening roller for the purpose of a pivotal adjustment on an arcuate, for example circular adjustment track, this arcuate or circular adjustment track surrounding the outer surface of the deflection roller. The deflection roller can also be stationary in this case. A pivotal adjustment of this type on an arcuate track of motion surrounding the deflection roller also leads to only slight differences in the free strip length occurring with different wrap angles and the free strip length always remains below the desired limit value above which longitudinal waviness would occur between the deflection roller and straightening roller Finally, in an alternative embodiment the free strip lengths can also be minimized in that not only the straightening roller is moved relative to the deflection roller, but the straightening roller as well as the associated deflection roller are moved in a suitable manner. Thus it is possible for example to move the straightening roller perpendicular to the strip-travel direction and (at the same time) to move the deflection roller in parallel to or along the strip-travel direction. This combined movement likewise means that the straightening roller moves relative to the deflection roller on a kind of circumferential track or a tangential track.

Within the scope of the invention relatively large spacings can always be set between two straightening rollers in a row one after the other, wherein the spacing is preferably at least 30%, particularly preferably at least 50% of the (maximum) strip width. Maximum strip width means the maximum strip width of the metal strip processed in a concretely designed stretch-bend-leveler.

Within the scope of the invention it is also important that the deflection rollers have a much larger diameter than the straightening rollers, since the deflection rollers are to have only an elastic effect. It is therefore expedient if the diameter of the deflection rollers is greater by at least a factor of 5, preferably at least a factor of 8 than the diameter of the respective straightening roller. It can therefore be expedient if the diameter of the deflection roller is greater by approximately a factor of 10 than the diameter of the respective straightening roller.

The diameter of the straightening roller(s) is preferably up to 70 mm, for example, up to 50 mm. Thus the diameter of the straightening roller or the straightening rollers can be, for example, 15 mm to 70 mm, preferably 25 mm to 50 mm.

The diameter of the deflection roller or the deflection rollers is preferably at least 150 mm, particularly preferably at least 250 mm. Thus the diameter of a deflection roller or several deflection rollers or also all deflection rollers can be for example 150 mm to 700 mm, preferably 250 mm to 600 mm.

The wrap angle of the strip around one or more straightening rollers or around the straightening rollers is generally 2° to 45°, preferably 3° to 30°.

Within the scope of the invention therefore one or more roller combinations are important to a special extent, which each have a deflection roller and an assigned straightening roller. Preferably two such roller combinations are provided, particularly preferably three roller combinations. It is thereby fundamentally within the scope of the invention when an upstream deflection roller is actually assigned to each straightening roller. However, it is preferably provided that the described roller combinations of deflection roller and straightening roller are provided in a first apparatus section, in which at least 75%, preferably at least 95% of the entire plastic elongation of the strip is generated. It is usual with stretch-bend levelers that the essential part of the stretch ratio is generated on the upstream straightening rollers and consequently in the first apparatus section, while at the other, downstream straightening rollers the residual bending moments are mainly eliminated. According to the invention it is now provided that the described roller combinations are preferably provided in the (upstream) first apparatus section, in which at least 75%, preferably at least 95% of the plastic elongation of the strip is generated. Accordingly, it can be expedient or sufficient if in a (downstream) second apparatus section in which essentially the residual curvatures in the strip after leveling are minimized or adjusted to desired values, and as a rule only up to 25%, preferably only up to 5% of the plastic elongation is generated, only one or more straightening rollers are provided, wherein in this region assigned deflection rollers can be omitted. It is expedient thereby if the first apparatus section has two or three roller combinations of straightening roller and upstream deflection roller with the described adjustment possibilities. The second apparatus section for the correction of the residual curvature then has at least two individually position-controlled straightening rollers, wherein in this region deflection rollers can be omitted. However, it is within the scope of the invention that deflection rollers are also provided in the region of this second apparatus section.

Alternatively, a set of four straightening rollers can be provided downstream of the described roller combinations with short free strip length.

The invention otherwise also relates to a stretch-bend leveler for stretch-bend leveling metal strip with a method of the described type.

BRIEF DESCRIPTION OF THE DRAWING

The invention is explained in more detail below based on drawings showing merely illustrated embodiments. Therein.

SPECIFIC DESCRIPTION OF THE INVENTION

Figure 1:
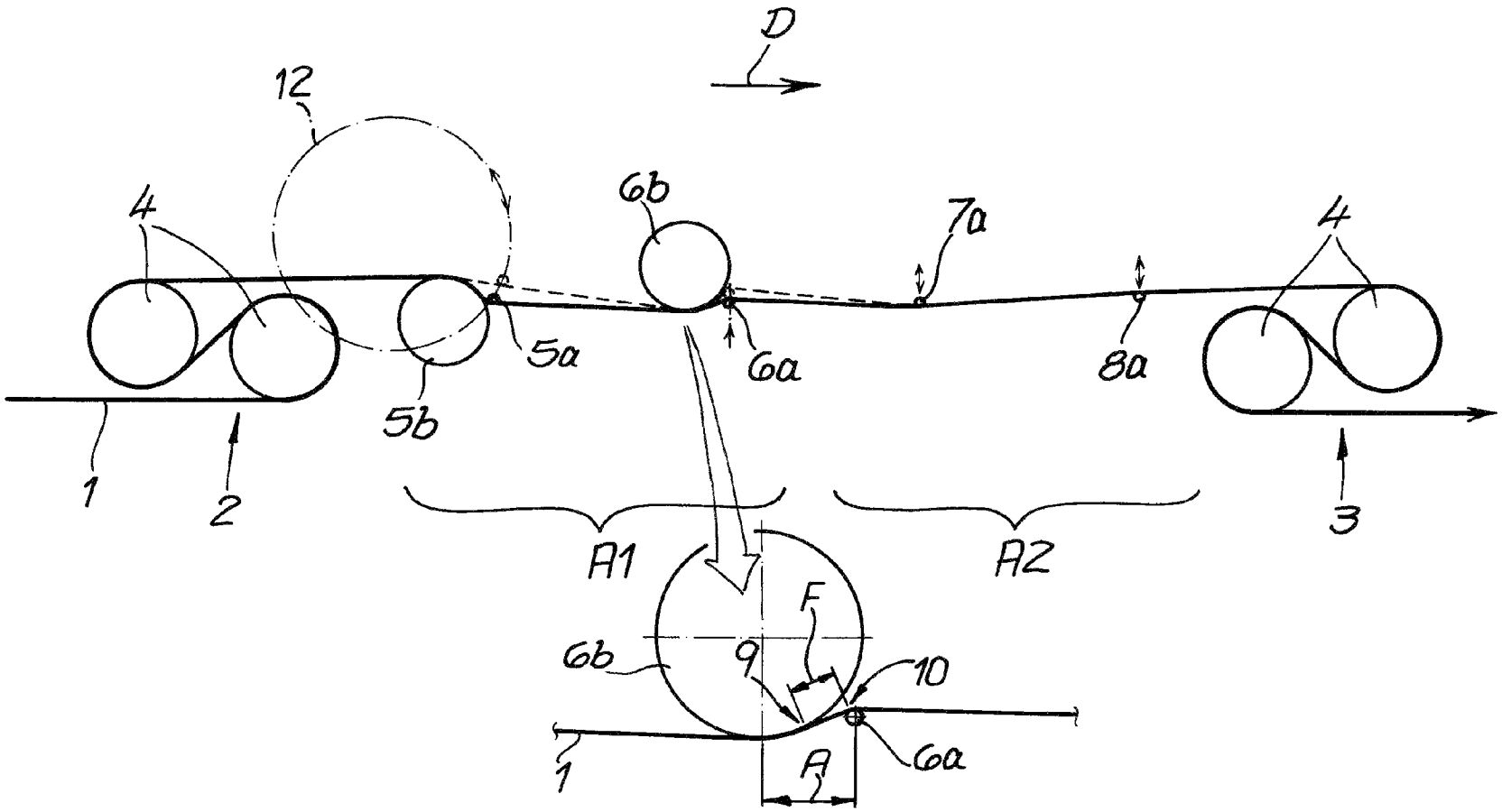
FIG. 1 is a diagrammatic view of a stretch-bend leveler in a first embodiment for carrying out the method according to the invention.

The figures show a stretch-bend leveler for stretch-bend leveling metal strip 1. A stretch-bend leveler of this type has in its basic structure a set 2 of input tension rollers and a set 3 of output tension rollers as well as straightening rollers 5*a*, 6*a*, 7*a*, 8*a* between these sets of tension rollers 2 and 3. The set 2 of input tension rollers with the tension rollers 4 can be designed as a set of brake rollers, while the set 3 of output tension rollers with the tension rollers 4 can be designed as a set of draw rollers. The strip-travel direction D runs horizontally or essentially horizontally.

These tension sets 2 and 3 generate in the metal strip 1 a tensile stress that is, however, below the elastic limit of the strip material. The strip is then bent bidirectionally around the straightening rollers 5*a* through 8*a* in the plastic or elastic-plastic range and thereby plastically stretched and consequently elongated. Each straightening roller 5*a*, 6*a*, 7*a*, 8*a* can thereby fundamentally be supported in a manner known per se by at least two support rollers. These are not shown in the figures.

The individual straightening rollers 5*a*, 6*a*, 7*a* and 8*a* for adjustment of the process control to a variety of conditions are movable relative to the strip, so that the immersion depth of the straightening roller 5*a*, 6*a*, 7*a*, 8*a* and thus also the wrap angle of the strip around the straightening roller can be varied. It is further discernible in the figures that deflection rollers 5*b*, 6*b*, 7*b* are assigned to some of the straightening rollers.

To this end we refer first of all to FIG. 1 that in a diagrammatically simplified manner shows a stretch-bend leveler in a first embodiment. It is first discernible that stretch-bend levelers with several straightening rollers 5*a*-8*a* are generally composed of a first apparatus section A1 and a second apparatus section A2, where in the first apparatus section A1 several straightening rollers 5*a*, 6*a* are provided that themselves produce the stretch ratio. In the second apparatus section A2 several straightening rollers 7*a*, 8*a* are likewise provided that eliminate the residual bending moments. In the first apparatus section A1 the deflection rollers 5*b* and 6*b* are now assigned to the straightening rollers 5*a* and 6*a*, one deflection roller 5*b*, 6*b* being upstream of each straightening roller 5*a*, 6*a*. The deflection rollers 5*b* and 6*b* here have a much larger diameter than the respective straightening rollers 5*a* and 6*a* so that the deflection rollers 5*b* and 6*b* act essentially merely elastically.

It is fundamentally advantageous if—as also indicated in FIG. 1—relatively large spacings are provided between the individual straightening rollers 5*a*, 6*a*, 7*a*, 8*a*, since these larger spacings between the straightening rollers lead to lower or completely eliminated residual waviness. However, the problem can arise that with such large spacings the strips have a tendency to elastic longitudinal waviness, the so-called handkerchief effect. This problem occurs in particular with thin strips that are under high tensile stress over a larger distance. If a strip with longitudinal waviness of this type runs over a straightening roller, this longitudinal waviness will be plastically embossed in the strip and negatively influences the straightening result. Within the scope of the invention such longitudinal waviness upstream of the straightening roller is now to be prevented. This effect has an impact mainly on the straightening rollers, on which the strip is noticeably plastically elongated. For the last straightening rollers, with which essentially only a partially plastic residual curvature correction is carried out, this elastic longitudinal waviness is unimportant or merely of secondary importance.

FIG. 1 shows that the straightening rollers 5*a*, 6*a*, upstream of which respective deflection rollers 5*b*, 6*b* are provided, can also be positioned against the strip 1, so that the immersion depth can be varied. A pivotal adjustment is known in principle from the prior art, as indicated with the straightening roller 5*a*, as well as a vertical adjustment, as indicated with the straightening roller 6*a*. FIG. 1 shows that when varying the immersion depth the free strip length F between the run-off point 9 of the strip from the deflection roller up to the take-up point 10 of the strip onto the straightening roller varies. The free strip length F can now also be minimized with this conventional adjustment if namely the straightening roller 5*a* or 6*a* is relatively close downstream to the respective deflection roller 5*b* or 6*b* and if consequently the spacing A in the strip-travel direction D is kept relatively small. Then even with conventional adjustment of the straightening rollers 5*a* or 6*a* according to FIG. 1, the free path length F remains very small so that longitudinal waviness is avoided.

Figure 2:
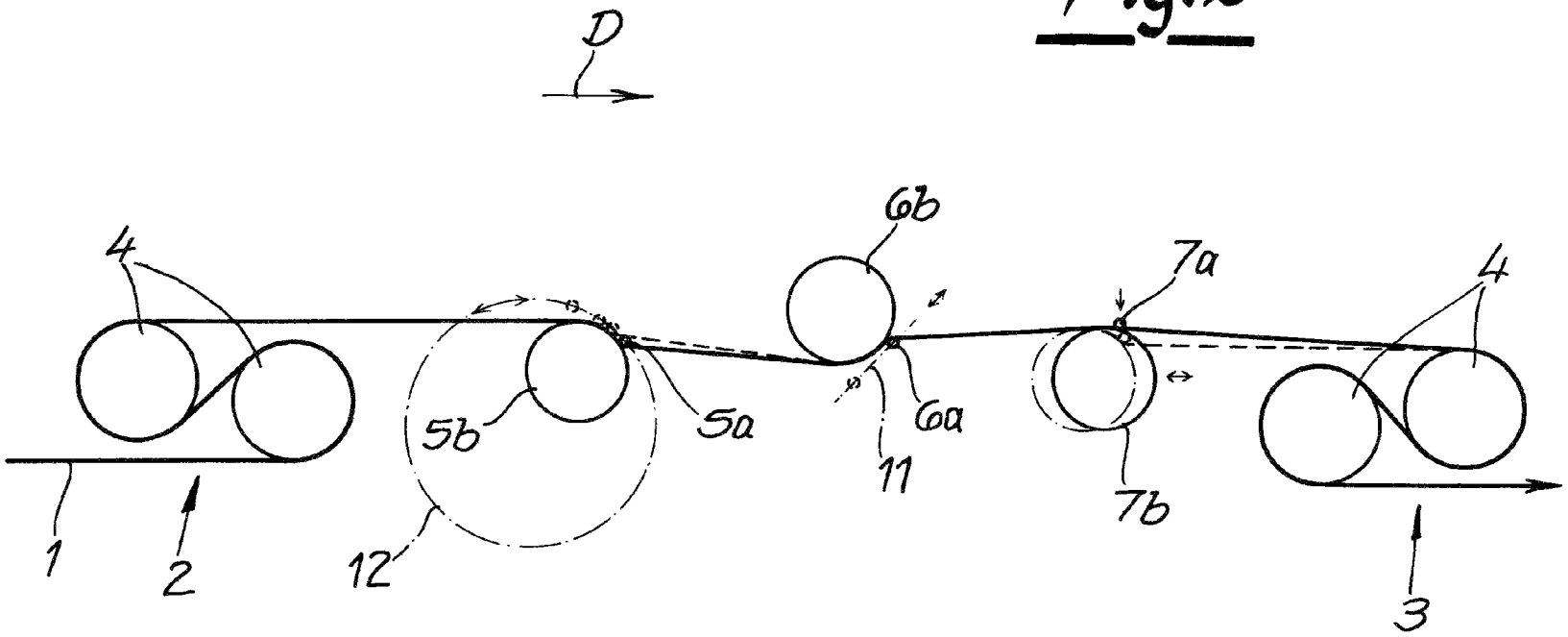
FIG. 2 shows a stretch-bend leveler according to the invention in a second embodiment.
Figure 3:
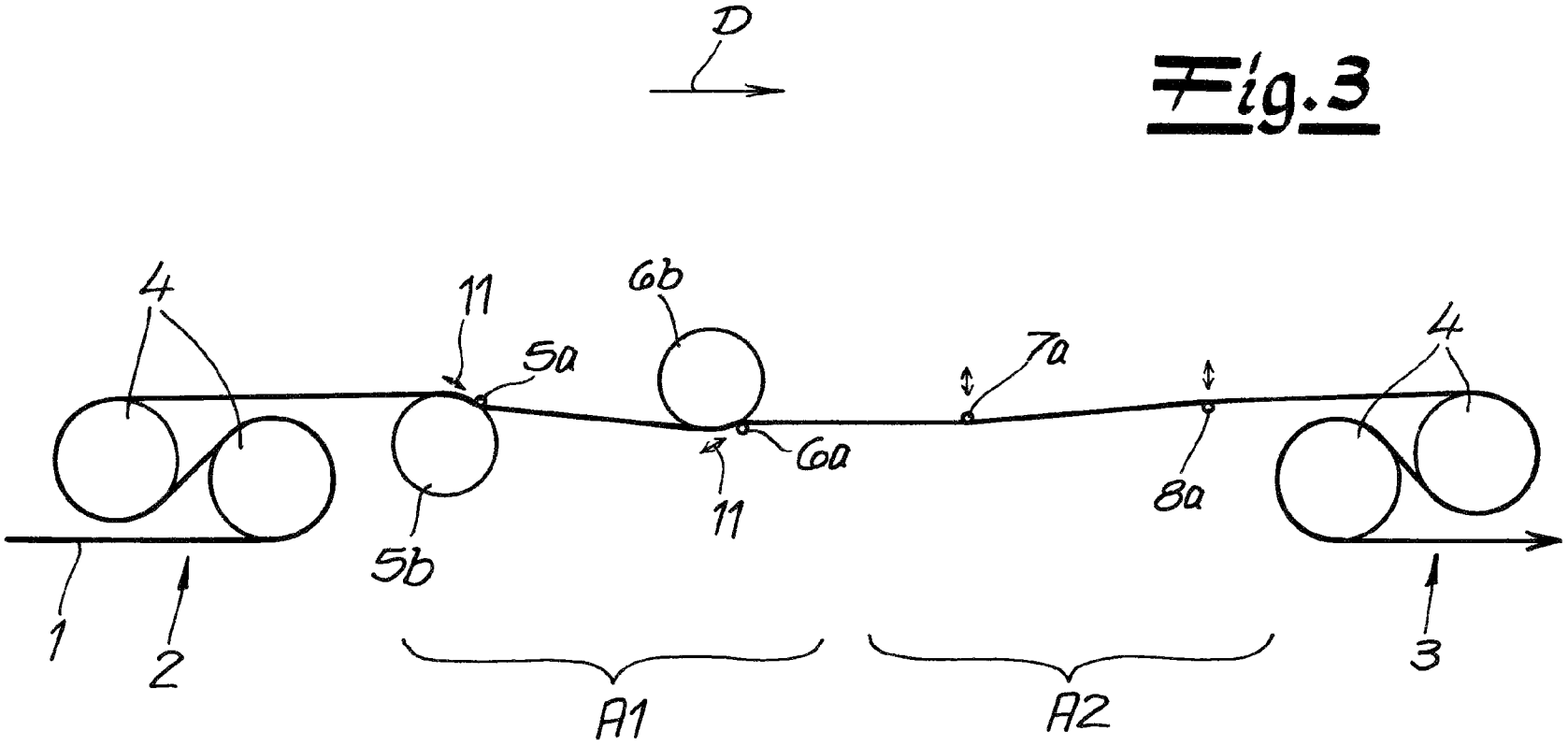
FIG. 3 shows a third embodiment of the invention and FIG. 4 shows a fourth embodiment of the invention.
Figure 4:
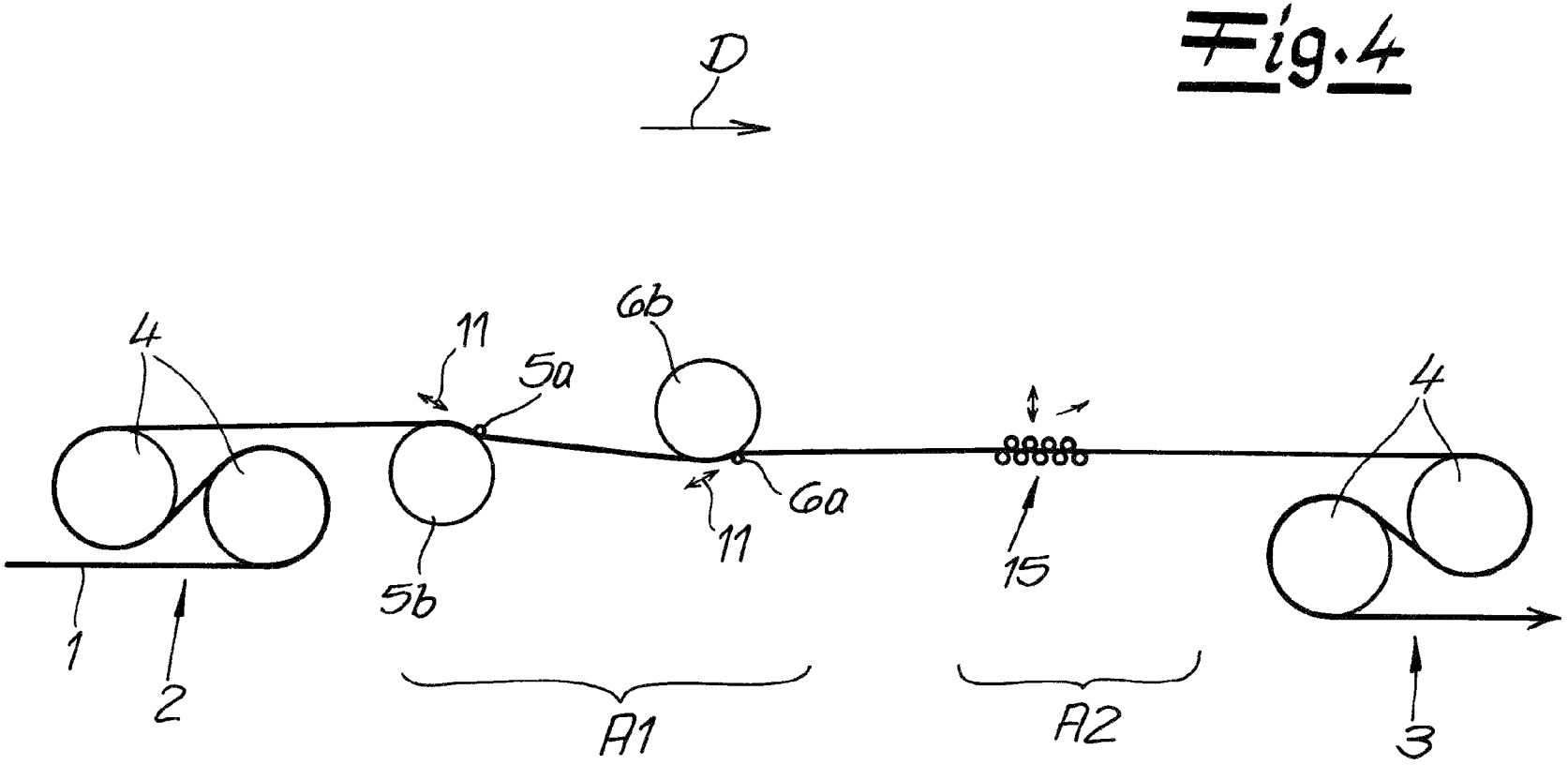

FIGS. 2, 3 and 4 in contrast show a preferred embodiment in which the free strip length can also be varied over a large adjustment range of the wrap angle.

To this end, the straightening rollers 5*a*, 6*a* or 7*a* for the variation of the immersion depth are now shifted relative to the respective deflection roller 5*b*, 6*b*, or 7*b* such that the free strip length F between the run-off point 9 of the strip from the deflection roller up to the take-up point 10 of the strip onto the assigned straightening roller remains as small as possible and does not exceed a predetermined maximum value. To this end the straightening rollers or some of the straightening rollers when varying the immersion depth can be moved angularly of or tangentially to the deflection rollers.

This can be realized structurally in different ways. Three different possibilities are shown in FIGS. 2, 3 and 4. The run-off point 9, the take-up point 10 and the free strip length F are not explicitly shown in FIGS. 2, 3 and 4, but the definition results from FIG. 1 and the corresponding explanations apply to these views.

FIG. 2 shows by way of example the three different possibilities of the adjustment for the individual straightening rollers.

In the region of the first straightening roller 5*a* of the apparatus according to FIG. 2, the possibility is shown of moving the straightening roller 5*a* for the purpose of a pivotal adjustment on an arcuate and, in the illustrated embodiment, circular adjustment track 12. In contrast to the known adjustment track shown in FIG. 1, the adjustment track 12 in the embodiment according to the invention according to FIG. 2 surrounds the outer circumference of the deflection roller 5*b* that can be stationary in the illustrated embodiment. Through this special design of the pivotal adjustment, the straightening roller 5*a* when varying the immersion depth is moved over a relatively long adjustment path such that a minimal free strip length F is always retained.

With the second straightening roller 6*a* shown in FIG. 2, this straightening roller 6*a* can be moved in a straight line for the purpose of a linear adjustment. In contrast to the linear adjustment shown in FIG. 1 with the second roller, however, according to the invention there is no vertical adjustment, but the straightening roller 6*a* can be moved in a straight line on an adjustment track 11 running obliquely to the strip-travel direction D. In turn the deflection roller 6*b* can be stationary. FIG. 2 shows that in this manner an essentially tangential adjustment track 11 is realized so that a minimization of the free strip length F is likewise retained over relatively long adjustment paths.

Based on the third straightening roller 7*a* according to FIG. 2 a further possibility is discernible for how a minimal free strip length can be obtained when varying the immersion depth. To this end the straightening roller 7*a* as well as the deflection roller 7*b* are moveable, but in different directions.

While the straightening roller 7*a* for the purpose of a vertical adjustment is moveable transversely to the strip-travel direction D, the assigned deflection roller 7*b* for the purpose of a horizontal adjustment can be moved in the strip-travel direction D and consequently can be moved horizontally. The free strip lengths F can likewise be minimized through combined movement.

With the different possibilities shown in FIG. 2, the free strip lengths can now always be held under a limit value, above which longitudinal waviness between the deflection roller and straightening roller would occur. The described handkerchief effect can be consequently avoided, so that overall optimal planarity results are achieved. This is in particular successful when the bending intensities of the individual straightening rollers are varied and to this end the immersion depth or the wrap angle of the strip around the straightening roller is varied. Consequently, strips of different thickness, width and yield point can be straightened with the stretch-bend levelers according to the invention. FIG. 2 is intended to illustrate in particular the different adjustment possibilities so that the adjustment according to the invention is shown there for all of the straightening rollers 5*a*, 6*a* and 7*a*, However, in practice it is generally sufficient if an adjustment of this type according to the invention of the straightening rollers based on the deflection rollers is provided in the first apparatus section A1. To this end we refer to the illustrated embodiments according to FIGS. 3 and 4.

FIG. 3 shows in turn a stretch-bend leveler with four straightening rollers 5*a*, 6*a*, 7*a* and 8*a*. One respective deflection roller 5*b* or 6*b*, which is movable according to the invention, is assigned to at least the first two straightening rollers 5*a*, 6*a*. In the illustrated embodiment according to FIG. 3 the described oblique adjustment is realized. In contrast a conventional vertical adjustment is provided for the two straightening rollers 7*a*, 8*a* in the second apparatus section A2. As already explained, the problem of longitudinal waviness upstream of the straightening roller occurs mainly on the straightening rollers on which the strip is still noticeably plastically elongated. For the last straightening rollers, with which essentially only a partially plastic residual curvature correction is carried out, the elastic longitudinal waviness is merely of secondary importance. In this respect in the region of the straightening rollers 7*a*, 8*a* the deflection rollers according to the invention or the adjustment according to the invention of the straightening rollers based on the deflection rollers can be omitted. The residual curvature correction is consequently carried out by at least the two straightening rollers 7*a* and 8*a* whose positions are individually controllable. However, it is also within the scope of the invention that deflection rollers are provided upstream or downstream of these straightening rollers 7*a*, 8*a*.

FIG. 4 shows an alternative embodiment of the invention in which overall a four-roller straightening unit 15 is provided downstream of the two straightening rollers 5*a* and 6*a*, to which corresponding deflection rollers 5*b* and 6*b* are assigned. This four-roller straightening unit can carry out the residual curvature corrections. This four-roller straightening unit 15 can have stationary lower rollers and movable upper rollers. This is merely indicated in FIG. 4.

FIGS. 3 and 4 otherwise show embodiments in which corresponding deflection rollers 5*b*, 6*b* are provided upstream only of the first two straightening rollers 5*a*, 6*a*. However, it can also be expedient to provide a corresponding deflection roller 7*b* upstream of a third straightening roller 7*a*. This embodiment is not shown in FIGS. 3 and 4. However, it must be taken into consideration that with several straightening rollers in a row one after the other, successively less and less stretch ratio is generally produced from straightening roller to straightening roller so that the problems regarding the longitudinal waviness at the end of the apparatus become less critical.

The invention claimed is:

1. A method for stretch-bend leveling metal strip with a stretch-bend leveler with at least two straightening rollers in a row one after the other in a strip-travel direction, the method comprising the steps of:

spacing the straightening rollers in the travel direction by at least 30% of a width of the strip, bending the strip under tensile stress below the elastic limit bidirectionally around the straightening rollers such that the strip undergoes plastic stretching, providing upstream of each of the straightening rollers movable relative to the strip a respective deflection roller having a larger diameter than the respective straightening roller provided immediately downstream, engaging the straightening rollers at least generally transversely of the travel direction with the strip such that the strip wraps around each of the straightening rollers over a predetermined wrap angle and with a predetermined immersion depth and that a free strip length of the strip extends straight between contact of the strip with each of the deflection rollers and contact with the respective straightening rollers, and positioning the straightening rollers for the variation of the immersion depth relative to the respective deflection rollers such that the free strip length does not exceed a predetermined maximum value equal to 8% of the strip width to prevent formation of longitudinal waviness of the strip.

2. The method according to claim 1, wherein the free strip length does not exceed a maximum value of 150 mm over the entire adjustment range of the straightening roller.

3. The method according to claim 1, wherein the straightening roller for the variation of the immersion depth is moved perpendicular or approximately perpendicular to the strip-travel direction, the spacing of the straightening roller to the deflection roller being so small that the free strip length over the entire adjustment region always remains below the maximum value or does not exceed it.

4. The method according to in claim 1, wherein the straightening roller when varying the immersion depth is moved essentially angularly of the deflection roller or tangentially to the deflection roller.

5. The method according to claim 4, wherein the straightening roller for the purpose of linear adjustment is moved in a straight line on an adjustment track extending obliquely to the strip-travel direction relative to a deflection roller mounted stationary.

6. The method according to claim 4, wherein the straightening roller for the purpose of a pivotal adjustment is moved on an arcuate adjustment track that surrounds the outer surface of the deflection roller stationary.

7. The method according to claim 4, wherein, when varying the immersion depth, the straightening roller as well as the respective deflection roller are moved.

8. The method according to claim 7, wherein the straightening roller is moved in a straight line perpendicular to the strip-travel direction and the deflection roller is moved parallel to the strip-travel direction.

9. The method according to claim 1, wherein the wrap angle of the strip around the straightening roller is 2° to 45°.

10. The method according to claim 1, with one or more roller combinations of one deflection roller and a straightening roller, the roller combination being provided in a first apparatus section in which at least 75% of the entire plastic elongation is generated.

11. The method according to claim 10, wherein one or more of the straightening rollers are provided downstream of the roller combinations of deflection roller and straightening roller, these downstream straightening rollers being provided in a second apparatus section in which for the correction of residual curvatures only up to 25% of the entire plastic elongation is produced.

12. A stretch-bend leveler for stretch-bend leveling metal strip, the leveler comprising:

at least two straightening rollers in a row one after the other and spaced apart in strip-travel direction by a distance equal to at least 30% of a width of the strip, means for bending the strip under tensile stress below the elastic limit bidirectionally around the straightening rollers such that the strip undergoes plastic stretching, a respective deflection rollers upstream of each of the straightening rollers and movable relative to the strip, the deflection rollers having a larger diameter than the respective straightening rollers, the straightening rollers being positioned relative to the respective deflection rollers such that the strip wraps around each of the straightening rollers over a predetermined wrap angle and with a predetermined immersion depth and that a free strip length of the strip extends straight between contact of the strip with each of the deflection rollers and contact with the respective straightening rollers, and means for moving the straightening roller for the variation of the immersion depth relative to the respective deflection roller such that the free strip length with different immersion depths or wrap angles never exceeds a maximum value equal to 8% of the strip width to prevent formation of longitudinal waviness of the strip.

13. The apparatus according to claim 12, wherein the diameter of the deflection roller is greater by at least a factor of 5 than the diameter of the respective straightening roller.

14. The apparatus according to claim 12, wherein the diameter of the straightening roller is up to 70 mm.

15. The apparatus according to claim 12, wherein the diameter of the deflection roller is at least 150 mm.

16. The apparatus according to that claim 12, wherein the straightening roller in the course of variation of the immersion depth is movable essentially angularly of the deflection roller or tangentially to the deflection roller.

17. The apparatus according to claim 16, wherein the straightening roller for the purpose of a linear adjustment is movable on an adjustment track extending obliquely to the strip-travel direction relative to a deflection roller mounted stationary.

18. The apparatus according to claim 16, wherein the straightening roller for the purpose of a pivotal adjustment is movable on an arcuate adjustment track that surrounds the outer surface of the deflection roller mounted stationary.

19. The apparatus according to claim 16, wherein, when varying the immersion depth, the straightening roller as well as the respective deflection roller are moveable, the straightening roller being moveable in a straight line perpendicular to the strip-travel direction and the deflection roller being moveable parallel to the strip-travel direction.

20. The apparatus according to claim 12, with one or more roller combinations of one deflection roller and a straightening roller, the roller combination being provided in a first intake-side apparatus section in which at least 75% of the entire plastic elongation is produced, one or more of the straightening rollers being provided downstream of the roller combinations of deflection roller and straightening roller, these downstream straightening rollers being provided in a second apparatus section in which for the correction of residual curvatures only up to 25% of the entire plastic elongation is produced.

21. The apparatus according to claim 20, wherein the second apparatus section for correction of the residual curvature has at least two individually position-controlled straightening rollers.

22. The apparatus according to claim 20, wherein the second apparatus section for the correction of the residual curvature has a set of four of the straightening rollers.

* * * * *